US008143773B2

(12) United States Patent
Suzuki et al.

(10) Patent No.: US 8,143,773 B2
(45) Date of Patent: Mar. 27, 2012

(54) SPARK PLUG

(75) Inventors: Akira Suzuki, Nagoya (JP); Tomoaki Kato, Nagoya (JP); Mamoru Musasa, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 13 days.

(21) Appl. No.: 12/933,192

(22) PCT Filed: Mar. 17, 2009

(86) PCT No.: PCT/JP2009/055169

§ 371 (c)(1),
(2), (4) Date: Sep. 17, 2010

(87) PCT Pub. No.: WO2009/116533

PCT Pub. Date: Sep. 24, 2009

(65) Prior Publication Data

US 2011/0018422 A1 Jan. 27, 2011

(30) Foreign Application Priority Data

Mar. 18, 2008 (JP) ..... 2008-069865

(51) Int. Cl.
*H01T 13/00* (2006.01)

(52) U.S. Cl. ..... 313/144; 313/118; 313/140

(58) Field of Classification Search ..... 313/118, 313/139–144

See application file for complete search history.

(56) References Cited

U.S. PATENT DOCUMENTS

| | | | |
|---|---|---|---|
| 2003/0102791 | A1 | 6/2003 | Suzuki |
| 2004/0222728 | A1 | 11/2004 | Suzuki et al. |
| 2005/0110381 | A1 | 5/2005 | Kanao |
| 2006/0042610 | A1 | 3/2006 | Abe et al. |

FOREIGN PATENT DOCUMENTS

| | | | |
|---|---|---|---|
| JP | 2003-168540 | A | 6/2003 |
| JP | 2003-282218 | A | 10/2003 |
| JP | 2005-129377 | A | 5/2005 |
| JP | 2006-100250 | A | 4/2006 |

*Primary Examiner* — Joseph L Williams
(74) *Attorney, Agent, or Firm* — Sughrue Mion, PLLC

(57) ABSTRACT

When an insulator of a spark plug receives an external force in a bending direction perpendicular to an axis at a rear end side body portion, a position C where the insulator is supported by a crimping portion via a packing acts as a fulcrum, and a stress is applied between the position C and a position B where the insulator is supported by a ledge portion via a packing. When an insulator is designed in which the balance of size and modulus of section is adjusted so that τA which denotes a proof strength against bending between a rear end position A of the insulator and the position C and τB which denotes a proof strength against bending between the position B and the position C satisfy $0.71 \leqq \tau A/\tau B \leqq 1.27$, cracks can be prevented.

6 Claims, 5 Drawing Sheets

SPARK PLUG

TECHNICAL FIELD

The present invention relates to a spark plug which is built in an internal combustion engine for igniting an air-fuel mixture.

BACKGROUND ART

Conventionally, spark plugs are used in internal combustion engines for ignition. A general spark plug is such that an insulator which holds a center electrode within an axial hole thereof is held by a metal shell so as to surround circumferentially a circumference thereof, so that a spark discharge gap is formed between a ground electrode which is joined to the metal shell and a center electrode. In addition, a spark discharge generated in the spark discharge gap ignites an air-fuel mixture.

In recent years, there are demands on reduction in size and diameter of spark plugs to secure the degree of freedom in designing automotive engines for increase in output and fuel economy thereof, and reductions in diameter and thickness of metal shells and insulators have been attempted. As one of measures taken to achieve the attempt, although a measure is considered in which respective constituent components of a conventional spark plug are made smaller in size with their shapes remaining as they are, there is a possibility that a reduction in strength of the individual constituent components is called for in the event that the constituent components are simply reduced in size. Because of this, the sizes of the individual constituent components are balanced against each other so as to secure the strengths of the constituent components within the limited dimensions of the spark plug.

When the thickness of the insulator is reduced in association with the reduction in diameter of the spark plug, resulting in a reduction strength (rigidity) of the insulator, in the event that an external force is applied to the insulator in a direction perpendicular to an axial direction (a bending direction), cracks or fractures tend to be generated easily. There is a possibility that the external force in the bending direction is applied to the spark plug in the event that a mounting tool is brought into collision with a rear end side body portion (an insulator head portion) of the insulator which is exposed from a rear end of the metal shell when the spark plug is mounted in the engine. In addition, although a terminal metal base, which is connected electrically with a center electrode, is exposed at a rear end of the insulator, a plug cap attached to a lead wire for applying a voltage to a spark discharge gap is fitted on the terminal metal base after the spark plug has been mounted in the engine. When the spark plug is subjected to vibrations generated in association with the driving of the engine in this state, a load due to the weight of the plug cap is generated, leading to a possibility that the external force in the bending direction is applied to the rear end side body portion of the insulator.

To make it difficult for cracks or fractures to be generated in the insulator even though the external force in the bending direction is applied to the rear end side body portion of the insulator in the way described above, it may be good to secure the thickness of a portion of the rear end side body portion where the outside diameter of the rear end side body portion becomes minimum (a minimum outside diameter portion) by regulating the outside diameter and an inside diameter of the axial hole (a central through hole) at the outside diameter minimum portion. Further, it is desired to secure the strength against the external force applied to the insulator in the bending direction by regulating a modulus of section of the portion of the rear end side body portion where the outside diameter becomes minimum (for example, refer to Patent Document 1.).

Patent Document 1: JP-A-2006-100250

DISCLOSURE OF THE INVENTION

Problem that the Invention is to Solve

Incidentally, portions having different outside diameters are provided on an outer circumferential surface of the insulator, and holding the insulator by the metal shell is generally attained by a form in which the insulator is held and supported in the axial direction by crimping those portions. Namely, the insulator is held in such a form that the insulator is supported by the metal shell within the inner hole in the metal shell. Because of this, when the external force acting in the bending direction is applied to the rear end side body portion of the insulator, a point of effort is the position subjected to the external force, of the supported positions by the metal shell, a side of the insulator which lies closer to the point of effort, that is, a rear end side supported position acts as a fulcrum. In addition, although a point of application which is associated with the point of effort is generated on a front end side of the insulator, since a front end side supported position of the insulator by the metal shell functions to restrict the application of effort at the point of application, that is, the movement of the front end side of the insulator, a load in accordance with the external force is applied to the portion between both the supported position in the axial direction. Because of this, cracks or fractures are generated in the insulator within the inner hole in the metal shell only by simply attempting to increase the strength (rigidity) of the rear end side body portion of the insulator.

The invention has been made with a view to solving the problem, and an object thereof is to provide a spark plug which can increase the proof strength of an insulator against a local load concentration by adjusting the balance of the strength (rigidity) of the insulator based on supported positions of the insulator by a metal shell, so as to prevent the generation of cracks or fractures in the insulator.

Means for Solving the Problem

To achieve the object, a spark plug according to claim 1 comprises:

an insulator comprising: a front end side body portion having a stepped portion on a front end side of an outer circumferential surface thereof; an intermediate body portion formed on a rear end side of the front end side body portion and having a larger diameter than that of the front end side body portion; and a rear end side body portion formed on a rear end side of the intermediate body portion via a shoulder portion and having a smaller diameter than that of the intermediate body portion, the insulator holding a center electrode in an interior of an axial hole thereof which is formed in an axial direction;

a metal shell comprising a tool engagement portion for mounting the spark plug on an internal combustion engine and holding a portion of the insulator which lies from the shoulder portion to the stepped portion between a crimping portion formed on a rear end side with respect to the tool engagement portion and a ledge portion formed on a front end side with respect to the tool engagement portion within an inner hole of the metal shell and projecting radially inwards; and an annular packing interposed between the ledge portion and the stepped portion, wherein $$\tau A = LAX\max / ZX\max, \text{ and}$$

$$\tau B = (LAC \cdot LBY\max)/(LBC \cdot ZY\max),$$

at least either τA or τB is 0.47 or larger, and $0.71 \leqq \tau A/\tau B \leqq 1.27$ is satisfied, where, in the axial direction, A represents a position where a rear end of the insulator is situated;

B represents a position where the insulator and the packing are first brought into contact with each other from a front end side of the insulator;

C represents a position where the insulator and the clamping portion are first brought into contact with each other from a rear end side of the insulator;

LAC represents a length between the position A and the position C;

LBC represents a length between the position B and the position C;

X represents an arbitrary position between the position A and the position C;

Y represents an arbitrary position between the position B and the position C;

LAX represents a length between the position A and the position X;

LBY represents a length between the position B and the position Y;

ZX represents a modulus of section of the insulator at the position X;

ZY represents a modulus of section of the insulator at the position Y;

Xmax represents a position of the position X where LAX/ZX takes a maximum value;

Ymax represents a position of the position Y where LBY/ZY takes a maximum value;

LAXmax represents a length between the position A and the position X max;

LBYmax represents a length between the position B and the position Ymax;

ZXmax represents a modulus of section of the insulator at a portion where the position Xmax; and ZYmax represents a modulus of section of the insulator at a portion where the position Ymax.

A spark plug according to claim 2 comprises:

an insulator comprising: a front end side body portion having a stepped portion on a front end side of an outer circumferential surface thereof; an intermediate body portion formed on a rear end side of the front end side body portion and having a larger diameter than that of the front end side body portion; and a rear end side body portion formed on a rear end side of the intermediate body portion via a shoulder portion and having a smaller diameter than that of the intermediate body portion, the insulator holding a center electrode in an interior of an axial hole thereof which is formed in an axial direction;

a metal shell comprising a tool engagement portion for mounting the spark plug on an internal combustion engine and holding a portion of the insulator which lies from the shoulder portion to the stepped portion between a crimping portion formed on a rear end side with respect to the tool engagement portion and a ledge portion formed on a front end side with respect to the tool engagement portion within an inner hole of the metal shell and projecting radially inwards;

an annular first packing interposed between the ledge portion and the stepped portion; and an annular second packing interposed between the crimping portion of the metal shell and the shoulder portion or the rear end side body portion of the insulator, wherein $$\tau A = LAX\max / ZX\max, \text{ and}$$

$$\tau B = (LAC \cdot LBY\max)/(LBC \cdot ZY\max),$$

at least either τA or τB is 0.47 or larger, and $0.71 \leqq \tau A/\tau B \leqq 1.27$ is satisfied wherein, in the axial direction, A represents a position where a rear end of the insulator is situated;

B represents a position where the insulator and the first packing are first brought into contact with each other from a front end side of the insulator;

C represents a position where the insulator and the second packing are first brought into contact with each other from a rear end side of the insulator;

LAC represents a length between the position A and the position C;

LBC represents a length between the position B and the position C;

X represents an arbitrary position between the position A and the position C;

Y represents an arbitrary position between the position B and the position C;

LAX represents a length between the position A and the position X;

LBY represents a length between the position B and the position Y;

ZX represents a modulus of section of the insulator at the position X;

ZY represents a modulus of section of the insulator at the position Y;

Xmax represents a position of the position X where LAX/ZX takes a maximum value;

Ymax represents a position of the position Y where LBY/ZY takes a maximum value;

LAXmax represents a length between the position A and the position Xmax;

LBYmax represents a length between the position B and the position Ymax;

ZXmax represents a modulus of section of the insulator at a portion where the position Xmax; and ZYmax represents a modulus of section of the insulator at a portion where the position Ymax.

In a spark plug according to claim 1 or 2, the metal shell includes a mounting thread portion on the front end side with respect to the tool engagement portion in which threads are formed for mounting the spark plug on the internal combustion engine, and a nominal diameter of threads of the mounting thread portion is M10 or smaller.

In a spark plug according to any of Claims 1 to 3, an outside diameter of the rear end side body portion of the insulator is ϕ8.5 mm or smaller.

Advantage of the Invention

In the spark plug according to Claim 1 of the invention, since the proof strength against the local stress concentration can be increased by adjusting the balance of the size and modulus of section of the insulator, even though the rear end side body portion of the insulator is subjected to the external force in the bending direction perpendicular to the axial direction, the stress that is produced in accordance with the external force is dispersed in the interior thereof, whereby the stress is mitigated. As a result of which the generation of cracks or fractures in the insulator can be prevented. Although this will be described in greater detail below, by regulating the relationship between τA and τB, which will be described later, the balance of strength (rigidity) of the insulator is adjusted.

The insulator is held within the inner hole of the metal shell in such a manner as to be supported by the crimping portion and the ledge portion, via the packing, of the metal shell. Because of this, when the insulator receives the external force in the bending direction perpendicular to the axis at the rear end side body portion thereof, a point of effort is the position received the external force, the supported position of the insulator by the crimping portion which lies closer to the point of effort than the ledge portion (the position C where the crimping portion is brought into contact with the insulator at a rearmost end side) acts as a fulcrum. Then, since the movement of the point of application side is restricted by the supported position of the insulator by the ledge portion (the position B where the packing is brought into contact with the insulator at a frontmost end side), the stress corresponding to the external force received at the point of effort is applied to the portion of the insulator which lies between the position B and the position C.

Here, τA denotes a proof strength against bending taking place between the point A and the point C of the insulator, and is defined by a position Xmax where the strength (rigidity) of the insulator becomes the lowest between the position A lying at the rear end of the insulator and the position C. As the value of τA is smaller, the strength (rigidity) of the insulator becomes high. In addition, τB denotes a proof strength against a stress applied between the point B and the point C in accordance with bending taking place between the position A and the position C of the insulator, and is defined by a position Ymax where the strength (rigidity) of the insulator becomes the lowest between the position B and the position C. As the value of τB is smaller, the strength (rigidity) of the insulator also becomes high. Consequently, in the event that both the values of τA and τB are small, specifically speaking, both the values are smaller than 0.47, since the insulator originally has a sufficient proof strength against bending, strength balancing adjustment required for dispersion of the stress is not necessary.

Then, with a view to reducing the diameter of an insulator so as to realize a reduction in size of a spark plug, the invention is intended for an insulator tending to have cracks or fractures due to local stress concentration in the event that a rear end side body portion of the insulator is subjected to an external force in a bending direction, that is, an insulator in which at least either τA or τB takes a value equal to or larger than 0.47. According to the inventor and others, in an insulator in which at least either τA or τB takes a value equal to or larger than 0.47, when paying attention to the relationship between τA and τB (τA/τB) to adjust the balance of strength (rigidity) so as to mitigate the local stress concentration, it has been found that the insulator may be designed, satisfying: $0.71 \leqq \tau A/\tau B \leqq 1.27$, so as to prevent cracks or fracture of the insulator.

Also in the spark plug according to Claim 2 of the invention, since the proof strength against the local stress concentration can be increased by adjusting the balance of the size and modulus of section of the insulator, even though the rear end side body portion of the insulator is subjected to the external force in the bending direction perpendicular to the axial direction, the stress produced in accordance with the external is dispersed in the interior thereof, whereby the stress is mitigated. As a result of which the generation of cracks or fractures in the insulator can be prevented. Although this will be described more specifically below, by regulating the relationship between τA and τB, which will be described later, the balance of strength (rigidity) of the insulator is adjusted.

The insulator used in the spark plug according to the invention set forth in Claim 2 is held within the inner hole in the metal shell in such a manner that the insulator is supported by the crimping portion via the second packing and the ledge portion via the first packing of the metal shell. Because of this, when the insulator receives the external force in the bending direction perpendicular to the axis at the rear end side body portion thereof, a point of effort is the position received the external force, the supported position of the insulator by the crimping portion which lies closer to the point of effort than the ledge portion (the position C where the second packing is brought into contact with the insulator at a rearmost end side) acts as a fulcrum. Then, since the movement of the point of application side is restricted by the supported position of the insulator by the ledge portion (the position B where the first packing is brought into the insulator at a frontmost end side), the stress corresponding to the external force received at the point of effort is applied to the portion of the insulator which lies between the position B and the position C.

Here, τA denotes a proof strength against bending taking place between the point A and the point C of the insulator, and is defined by a position Xmax where the strength (rigidity) of the insulator becomes the lowest between the position A lying at the rear end of the insulator and the position C. As the value of τA is smaller, the strength (rigidity) of the insulator becomes high. In addition, τB denotes a proof strength against a stress applied between the point B and the point C in accordance with bending taking place between the position A and the position C of the insulator, and is defined by a position Ymax where the strength (rigidity) of the insulator becomes the lowest between the position B and the position C. As the value of τB is smaller, the strength (rigidity) of the insulator also becomes high. Consequently, in the event that both the values of τA and τB are small, specifically speaking, both the values are smaller than 0.47, since the insulator originally has a sufficient proof strength against bending, no strength balancing adjustment required for dispersion of the stress is not necessary.

Then, with a view to reducing the diameter of an insulator so as to realize a reduction in size of a spark plug, the invention is intended for an insulator tending to have cracks or fractures due to local stress concentration in the event that a rear end side body portion of the insulator is subjected to an external force in a bending direction, that is, an insulator in which at least either τA or τB takes a value equal to or larger than 0.47. According to the inventor and others, in an insulator in which at least either τA or τB takes a value equal to or larger than 0.47, when paying attention to the relationship between τA and τB (τA/τB) to adjust the balance of strength (rigidity) so as to mitigate the local stress concentration, it has been found that the insulator may be designed, satisfying: $0.71 \leqq \tau A/\tau B \leqq 1.27$, so as to prevent cracks or fracture of the insulator.

It is true, but in the event that in designing an insulator, a sufficient size can be secured, it will be easy to fabricate an insulator satisfying the fact that both τA and τB are smaller than 0.47, which becomes no more an objective of the invention as described above. Consequently, the invention is preferably applied to a spark plug with a small diameter which is susceptible to a limitation in designing an insulator, and more specifically, the invention is desirably applied to a spark plug as according to the invention set forth in Claim 3 in which a nominal diameter of threads formed in the mounting thread portion of the metal shell is M10 or smaller.

In addition, as described above, as an objective to which the invention is applied, a spark plug with a small diameter as according to the invention set forth in Claim 4 is desirable in which the outside diameter of the rear end side body portion of the insulator is required to be ϕ8.5 mm or smaller.

DESCRIPTION OF REFERENCE NUMERALS

6, 8 packing; 10 insulator; 11 stepped portion; 12 axial hole; 14 shoulder portion; 17 front end side body portion; 18 rear end side body portion; 19 intermediate body portion; 20 center electrode; 50 metal shell; 51 tool engagement portion; 52 mounting thread portion; 53 crimping portion; 59 ledge portion; 100 spark plug.

BEST MODE FOR CARRYING OUT THE INVENTION

Figure 1:
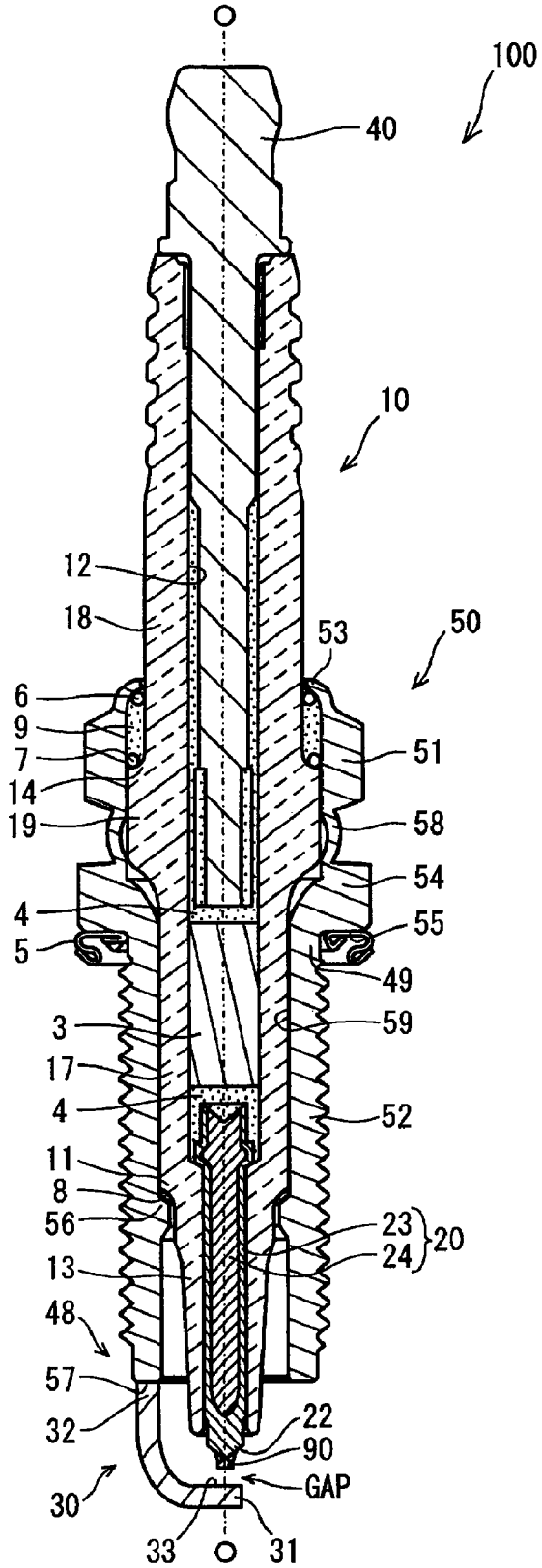
FIG. 1 is a vertical sectional view of a spark plug 100.

Hereinafter, an embodiment of a spark plug which embodies the invention will be described by reference to the drawings. Firstly, referring to FIG. 1, the construction of a spark plug 100 as an example will be described. FIG. 1 is a vertical sectional view of the spark plug 100. Note that in FIG. 1, the description will be made with a direction of an axis O of an insulator 10 referred to as a vertical direction, a lower side of the insulator referred to as a front end side of the spark plug 100 and an upper side referred to as a rear end side.

As is shown in FIG. 1, a spark plug 100 holds a center electrode 20 on a front end side of an interior of an axial hole 12 thereof and has an insulator 10 which holds a terminal metal base 40 at a rear end side thereof. Further, the spark plug 100 is constructed such that a circumference of the insulator 10 is circumferentially surrounded to be held by a metal shell 50. In addition, a ground electrode 30 is joined to a front end portion 48 of the metal shell 50, and a distal end portion 31 of the ground electrode 30 is bent to be directed towards a front end portion 22 of the center electrode 20, whereby a spark discharge gap GAP is formed between the distal end portion 31 and the front end portion 22.

Firstly, the insulator 10 of the spark plug 100 will be described. As is known well, the insulator 10 is an insulation member which is formed by calcining alumina or the like and has a cylindrical shape which has an axial hole 12 which extends in an axis O direction. An intermediate body portion 19, which has a largest outside diameter, is formed substantially centrally of the insulator 10 in the axis O direction, and a rear end side body portion 18, which connects to the intermediate body portion 19 via a shoulder portion 14 at a rear end of the intermediate body portion 19 while being reduced in diameter, is formed so as to extend towards a rear end side (an upper side in FIG. 1) of the insulator 10 in the axis O direction. In addition, the shoulder portion 14 is, strictly speaking, a portion of the intermediate body portion 19 and constitutes a portion where the shoulder portion 14 itself and the rear end side body portion 18 having a different diameter from that of the shoulder portion 14 are connected together at an upper portion (a rear end portion) of the intermediate body portion 19.

A front end side body portion 17, whose outside diameter is smaller than the rear end side body portion 18, is formed at a portion lying closer to a front end side (a lower side in FIG. 1) of the insulator 10 than the intermediate body portion 19, and a long leg portion 13, whose outside diameter is smaller than the front end side body portion 17, is formed at a portion lying closer to the front end side of the insulator 10 than the front end side body portion 17. The long leg portion 13 is reduced in diameter so that the diameter thereof decreases as the portion extends towards the front end side and is exposed in a combustion chamber when the spark plug 100 is mounted in a cylinder head of an internal combustion engine (out of the figure). A portion lying between the long leg portion 13 and the front end side body portion 17 is formed as a stepped portion 11.

Next, the center electrode 20 will be described. The center electrode 20 is a rod-like electrode having a construction in which a core material 24 formed of copper or an alloy which contains copper as a main constituent is embedded in an interior of an electrode base material 23 formed of Ni or an alloy which contains Ni as a main constituent such as Inconel (trade name) 600 or 601, the core material 24 having a superior heat conductivity to that of the electrode base material 23. The axial hole 12 of the insulator 10 is reduced in diameter at the long leg portion 12, and the center electrode 20 is disposed in the portion whose diameter is so reduced so as to be held by the insulator 10. The front end portion 22 of the center electrode 20 is made to project further than a front end of the insulator 10 and is formed so as to be reduced in diameter as the front end portion 22 extends towards the front end side. In addition, an electrode tip 90 is joined to a front end face of the front end portion 22 and the electrode tip 90 is formed of a noble metal so as to increase a spark wear resistance of the front end portion 22.

The center electrode 20 extends towards a rear end side of the insulator 10 within the axial hole 12 and is electrically connected with the terminal metal base 40 provided at a rear end side of the axial hole 12 by way of a conductive seal element 4 made up of a mixture of metal and glass and a ceramic resistance 3. The terminal metal base 40 is exposed to the outside from a rear end of the axial hole 12, and a high-tension cable (out of the figure) is connected to the exposed portion via a plug cap (out of the figure), so that a high voltage is applied to the center electrode 20 for spark discharge.

Next, the metal shell 50 will be described. The metal shell 50 is a cylindrical metal fixture for fixing the spark plug 100 in place in the cylinder head of the internal combustion engine which is out of the figure and has an inner hole 50 which penetrates therethrough in the axis O direction. The metal shell 50 holds the insulator 10 in such a manner as to surround a portion of the insulator 10 which extends from part of the rear end side body portion 18 to the long leg portion 13 within this inner hole 59. The metal shell 50 is formed of an iron-based material and includes a tool engagement portion 51 on which a spark plug wrench, which is out of the figure, is fitted and a mounting thread portion 52 on which threads are formed so as to screw into a mounting hole (out of the figure) in the cylinder head.

A collar-like seal portion 54 is formed between the tool engagement portion 51 and the mounting thread portion 52 of the metal shell 50. An annular gasket 5 formed by bending a sheet element is passed on the mounting thread portion 52 to fit on a thread neck portion 49 between the mounting thread portion 52 and the seal portion 54. When the spark plug 100 is mounted in the mounting hole (out of the figure) in the cylinder head, the gasket 5 is collapsed between a bearing surface 55 and a circumferential edge of an opening of the mounting hole to thereby be deformed, whereby a seal is established between the bearing surface 55 and the circumferential edge of the opening of the mounting hole so as to prevent the leakage of gases within the engine via the mounting hole.

A thin crimping 53 is provided on the metal shell 50 in a position lying closer to the rear end side than the tool engagement portion 51, and a thin buckling portion 58 like the crimping portion 53 is provided between the seal portion 54 and the tool engagement portion 51. Annular packings 6, 7 are interposed between a portion extending from the tool engagement portion 51 to the crimping portion 53 and a portion extending from the shoulder portion 14 to the rear end side body portion 18 of the insulator 10 within the inner hole 59 of the metal shell 50. Both the packings 6, 7 go around an outer circumference of the rear end side body portion 18 so as to surround the same portion and powder of talc 9 is filled between both the packings 6, 7. In addition, by the crimping portion 53 being crimped, the insulator 10 is pressed towards the front end side within the metal shell 50. By this, the stepped portion 11 of the insulator 10 is supported on a ledge portion 56 which is formed so as to project inwards in a position along the mounting thread portion 52 within the inner hole 59 of the metal shell 50 via an annular packing 8, whereby the metal shell 50 and the insulator 10 become integral with each other. As this occurs, the gas-tightness between the metal shell 50 and the insulator 10 is held by the packing 8, whereby combustion gases are prevented from flowing out from therebetween. In addition, the buckling portion 58 is made to be deflected and deformed radially outwards as a compression force is applied thereto when crimping the crimping portion 53, so as to extend the compression length of the talc 9 in the axis O direction to thereby increase the gas-tightness within the metal shell 50. Note that the packing 6 corresponds to the "second packing" of the invention, and the packing 8 corresponds to the "first packing" of the invention.

Next, the ground electrode 30 will be described. The ground electrode 30 is a rod-like electrode member which is formed of a metal having a high corrosion resistance, and as an example, a nickel alloy such as Inconel (trade name) 600 or 601 is used. This ground electrode 30 has a substantially rectangular cross section taken along a longitudinal direction thereof, and a proximal portion 32 at one end side thereof in its extending direction is joined to a front end face 57 of the metal shell 50 through welding. In addition, the distal end portion 31 at the other end thereof in its extending direction is bent so that one side thereof faces the front end portion 22 of the center electrode 20. In addition, the spark discharge gap GAP is formed between the distal end portion 31 of the ground electrode 30 and the front end portion 22 of the center electrode 20 where the electrode tip 90 is provided.

Figure 2:
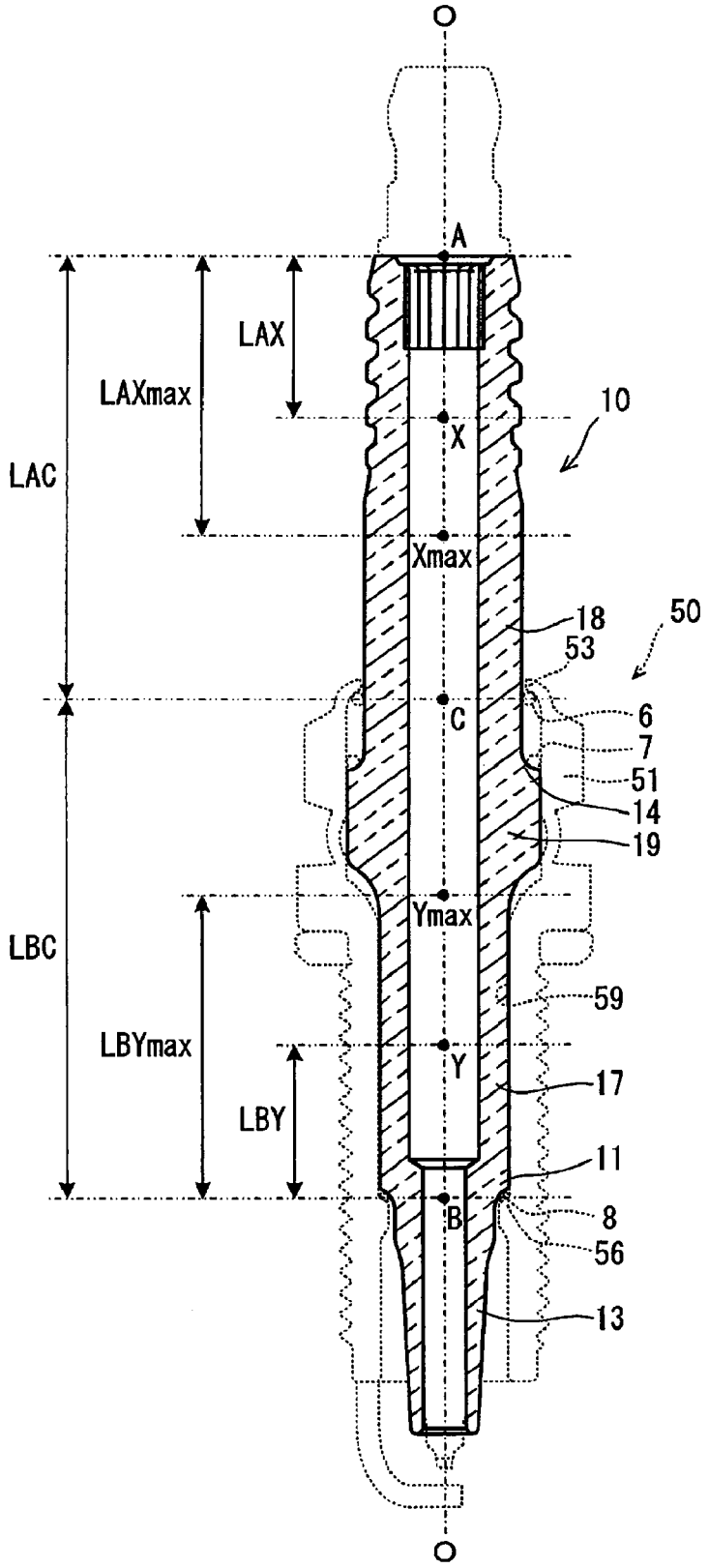
FIG. 2 is a sectional view of an insulator 10 which describes positions and sizes of portions which are set on the insulator 10.

In the spark plug 100 of the embodiment which is configured as described above, the size and modulus of section of each portion of the insulator 10 are specified, so as to realize an adjustment of balance of the overall strength (rigidity) of the insulator 10. Hereinafter, referring to FIG. 2, requirements made for the insulator 10 will be described. FIG. 2 is a sectional view of the insulator 10 which describes positions and sizes of portions which are set on the insulator 10.

Although the modulus of section will be briefly described since it is known, when letting an outside diameter of the insulator at an arbitrary position in the axial direction be D1 and an inside diameter of the axial hole at that specific position be D2, it is known that a modulus of section Z of the insulator at that specific position is obtained by the following equation (a).

$$Z=(\pi/32)\times(D1^4-D2^4)/D1 \quad \text{(a)}$$

Consequently, an upper limit value of the inner diameter D2 of the axial hole is such as to be determined by values of the outside diameter D1 and the modulus of section Z based on the above equation (a).

As has been described before, the insulator 10 is, as is shown in FIG. 2, held by the metal shell 50 so that the portion from part of the rear end side body portion 18 to the long leg portion 13 is accommodated within the inner hole 59 in the metal shell 50. More specifically, within the inner hole 59 in the metal shell 50, the packing 8 disposed at the ledge portion 56 and the packings 6, 7 which are disposed at the crimping portion 53 and the tool engagement portion 51 are in abutment with the stepped portion 11, the shoulder portion and the rear end side body portion 18 of the insulator 10, respectively. The insulator 10 is held by the metal shell 50 with the insulator 10 supported within the inner hole 59 in the metal shell 50 via those packings 6, 7, 8 by being crimped.

Consequently, in the event that the insulator 10 receives an external force which acts in the direction perpendicular to the axis O (the bending direction) at the rear end side body portion 18 thereof, letting the position which receives the external force be a point of effort, the position where the packing 6 which is brought into abutment with the insulator 10 at a rearmost end side is disposed acts as a fulcrum. The front end side of the insulator 10 acts as a point of application where an effort in accordance with the external force appears. However, since the front end side is supported by the metal shell 50 via the packing 8, a movement as an action in accordance with the external force applied is restricted. Because of this, in the insulator 10, when the external force in the bending direction is received at the rear end side body portion 18, a load is applied to a portion from the position where the packing 6 is disposed to the position where the packing 8 is disposed by a stress produced in accordance with the external force so applied.

Then, in the embodiment, requirements that enable the adjustment of balance of strength (rigidity) of the insulator 10 on both the sides in the axis O direction are specified so as to mitigate the load applied to the point of application side when the external force in the bending direction is received at the rear end side body portion 18. As is shown in FIG. 2, in the axis O direction, a rear end position of the insulator 10 is referred to as a position A. In addition, a position where the insulator 10 is first supported by the metal shell 50 from the rear end side of the insulator 10, that is, in this embodiment, the position where the packing 6 is disposed is referred to as a position C, which is then regarded as the fulcrum. Further, a position where the insulator 10 is first supported by the metal shell 50 from the front end side of the insulator 10, that is, in this embodiment, the position where the packing 8 is disposed is referred to as a position B. Then, a length between the position A and the position C is referred to as LAC, and a length between the position B and the position C is referred to as LBC.

Next, an arbitrary position between the position A and the position C is referred to as a position X, an arbitrary position between the position B and the position C is referred to as a position Y, a length between the position A and the position X is referred to as LAX, and a length between the position B and the position Y is referred to as LBY. Then, a modulus of section of the insulator 10 at a portion corresponding to the position X is referred to as ZX, and LAX/ZX is obtained. A position of the position X when the obtained value takes a maximum value is sought, and the position so sought is referred to as a position Xmax. Similarly, a modulus of section of the insulator 10 at a portion corresponding to the position Y is referred to as ZY, and LAX/ZY is obtained. A position of the position Y when the obtained value takes a maximum value is sought, and the position so sought is referred to as a position Ymax. Further, a length between the position A and the position Xmax is referred to as LAXmax, and a modulus of section of the insulator at a portion corresponding to the position Xmax is referred to as ZXmax. Similarly, a length between the position B and the position Ymax is referred to as LBYmax, and a modulus of section of the insulator 10 at a portion corresponding to the position Ymax is ZYmax.

Then, the following are defined:

$$\tau A = LAX\max / ZX\max \quad (1)$$

$$\tau B = (LAC \cdot LBY\max)/(LBC \cdot ZY\max) \quad (2)$$

In the spark plug 100 of the embodiment, it is required that at least either τA or τB is 0.47 or larger and that when obtaining τA/τB, $0.71 \leqq \tau A/\tau B \leqq 1.27$ is satisfied.

This requirement will be described in detail below. As has been described before, the rear end side body portion 18 of the insulator 10 which is held by the metal shell 50 is exposed from the rear end of the metal shell 50. A case is considered in which an external force in the bending direction perpendicular to the axis O is applied to the rear end side body portion 18. When letting a bending moment of the insulator 10 in the position X which is spaced the length LAX away from the position A be MX, MX is expressed as MX=FLAX. Similarly, a bending moment MY of the insulator 10 in the position B which is spaced the length LBY away from the position B is expressed as MY=(LAC/LBC)·F·LBY. Further, when obtaining a tensile force IX of the insulator 10 which is generated by bending at the portion corresponding to the position X, the following is obtained.

$$IX = MX/ZX = (F \cdot LAX)/ZX \quad (3)$$

Similarly, when obtaining a tensile force IY of the insulator 10 which is generated by bending at the portion corresponding to the position Y, the following is obtained.

$$\begin{aligned} IY &= MY/ZY \quad (4) \\ &= \{(LAC/LBC) \cdot F \cdot LBY\}/ZY \\ &= (LAC \cdot F \cdot LBY)/(LBC \cdot ZY) \end{aligned}$$

Here, the value of LAX/ZX becomes larger as the length between the position A and the position X becomes longer and as the modulus of section of the insulator 10 at the portion corresponding to the position X becomes smaller. Consequently, the position Xmax where LAX/ZX takes a maximum value denotes a position that can be taken by the position X when the strength (rigidity) of the insulator 10 becomes lowest between the position A to the position C. Therefore, the tensile force IXmax of the insulator 10 that is generated by bending at the portion from the position A to the position Xmax can be expressed from the equation (1) and the equation (3) as IXmax=(F·LAXmax)/ZXmax=F·τA.

Similarly, the value of LBY/ZY becomes larger as the length between the position B and the position Y becomes longer and as the modulus of section of the insulator 10 at the portion corresponding to the position Y becomes smaller. Consequently, the position Ymax where LBY/ZY takes a maximum value denotes a position that can be taken by the position Y when the strength (rigidity) of the insulator 10 becomes lowest between the position B to the position C. Therefore, the tensile force IYmax of the insulator 10 that is generated by bending at the portion from the position B to the position Ymax can be expressed from the equation (2) and the equation (4) as IYmax=(LAC·F·LBYmax)/(LBC·ZYmax)=F·τB. Here, since F denotes external force, τA denotes proof strength against the bending of the insulator 10 between the position A and the position C, and τB denotes proof strength against a stress applied between the position B and the position C in accordance with the bending of the insulator 10 between the position A and the position C. In designing the insulator 10, by paying attention to τA and τB, a relationship therebetween τA/τB is obtained so that the insulator 10 can obtain such a sufficient strength (rigidity) that the generation of cracks or fractures therein can be prevented.

Firstly, as to τA and τB, as has been described above, the smaller their values, the higher the strength (rigidity) of the insulator 10. Consequently, it is verified by evaluation tests in Example 1, which will be described later, that in the event that both τA and τB of the insulator 10 are smaller than 0.47, irrespective of a value of τA/τB, the insulator 10 can obtain such a sufficient strength (rigidity) that the generation of cracks or fractures therein can be prevented. Namely, in the event that both τA and τB become smaller than 0.47, the insulator 10 can obtain such a sufficient strength (rigidity) that the generation of cracks or fractures therein can be prevented without adjusting strictly the balance of the size and modulus of section of each portion of the insulator 10.

On the other hand, in the event that at least either τA or τB takes a value equal to or larger than 0.47, the balance of the size and modulus of section of each portion of the insulator 10 need to be adjusted to mitigate a stress produced in accordance with the external force received by the insulator 10. Specifically, an insulator 10 is designed in which the balance of the size and modulus of section of each portion of the insulator 10 are adjusted so that $0.71 \leqq \tau A/\tau B \leqq 1.27$ is satisfied when obtaining a value of τA/τB. It is verified by the evaluation tests in Example 1, which will be described later, that in the event that the insulator 10 is so designed, even though the insulator 10 receives the external force in the bending direction at the rear end side body portion 18, the effect of a load resulting from a stress produced in accordance with the external force applied to the portion between the position where the packing 6 is disposed to the position where the packing 8 is disposed can be mitigated so as to prevent the generation of cracks or fractures.

However, in the event that in designing an insulator 10, it can be ensured that the insulator 10 has a sufficient size, it is easy to satisfy the requirement that both τA and τB are smaller than 0.47, whereby the insulator 10 can obtain a sufficient strength without the invention being applied thereto. Consequently, the invention is preferably applied to a spark plug 100 with a small diameter, that is, a spark plug 100 in which at least either τA or τB tends to be equal to or larger than 0.47. More specifically, the invention is preferably applied to a spark plug 100 in which a nominal diameter of threads formed in a mounting thread portion 52 of a metal shell 50 is M10 or smaller. In the spark plug 100 of this size, since there is caused a limitation in securing the rigidity of the metal shell 50 when attempting to reduce the thickness thereof, there is caused a restriction to a size that can be secured as the outside diameter of the insulator 10. Consequently, the modulus of section of the insulator 10 tends to become small, as a result of which the values of τA and τB tend to take larger values. Also, as to a spark plug 100 which is required by design that the outside diameter of a rear end side body portion 18 of an insulator 10 be ϕ8.5 mm or smaller, similar to the spark plug 100 described above, the modulus of section of the insulator 10 tends to become small, and therefore, the invention is desirably applied thereto.

Needless to say, the invention can be modified variously. In this embodiment, in holding the insulator 10 by the metal shell 50, the metal shell 50 is made not to be brought into direct abutment with the insulator 10, but the metal shell 50 is designed to support the insulator 10 via the packings 6, 7, 8. Because of this, in supporting the insulator 10 by the metal shell 50, since it is the packing 6 that is brought into abutment with the insulator 10 at the rearmost end side in the axis O direction, the packing 6 acts as the fulcrum when the external force in the bending direction is applied to the rear end side body portion 18 of the insulator 10. Consequently, although the position where the packing 6 is disposed in the axis O direction is referred to as the position C, the position C is not necessarily limited to the position where the packing 6 is disposed.

Figure 3:
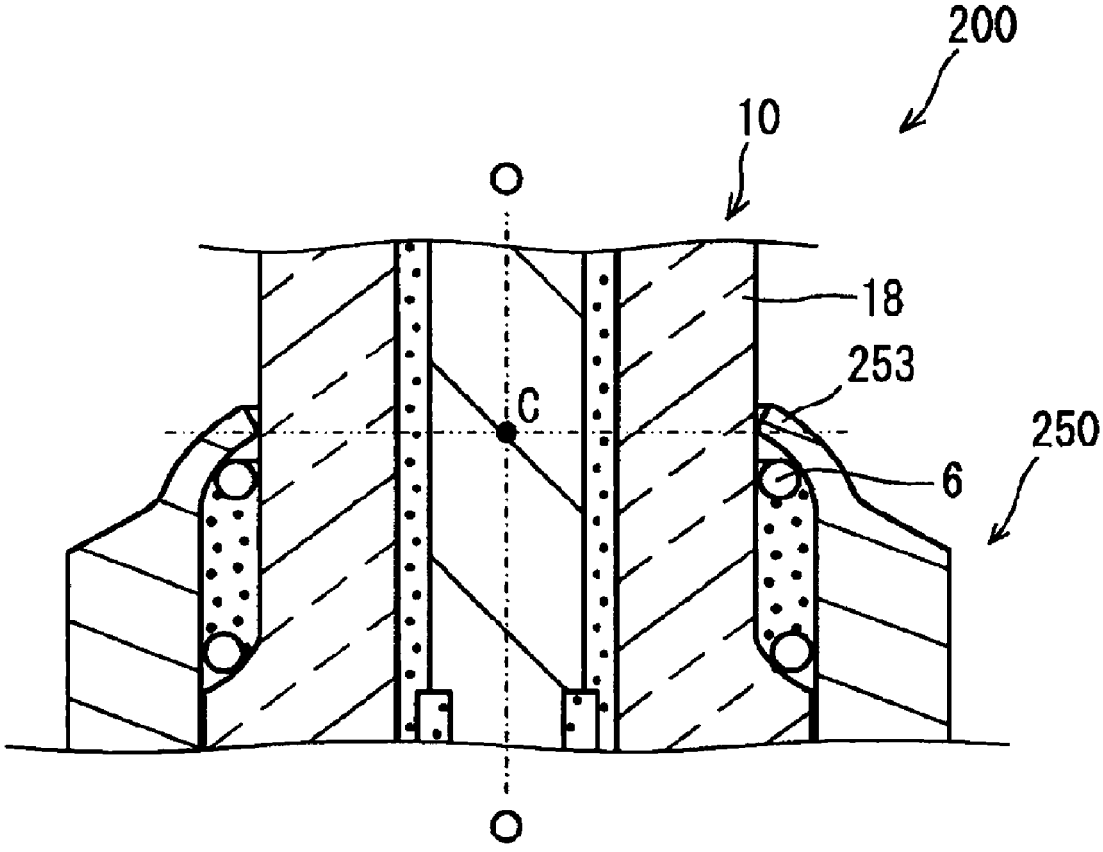
FIG. 3 is a partial sectional view of a spark plug 200 as a modified example.

For example, in a spark plug 200 shown in FIG. 3, as with the embodiment, although a packing 6 is brought into abutment with a rear side body portion 18 of an insulator 10, a crimping portion 253 of a metal shell 253 is brought into abutment with the rear end side body portion 18 in a position lying closer to a rear end side (an upper side in FIG. 3) in an axis O direction than the packing 6. In the case of the spark plug 200 configured as described above, since it is the crimping portion 253 that is first brought into abutment with the insulator 10 from the rear end side in the axis O direction, the position where the crimping portion 253 is brought into abutment with the insulator 10 may be referred to as a position C.

Figure 4:
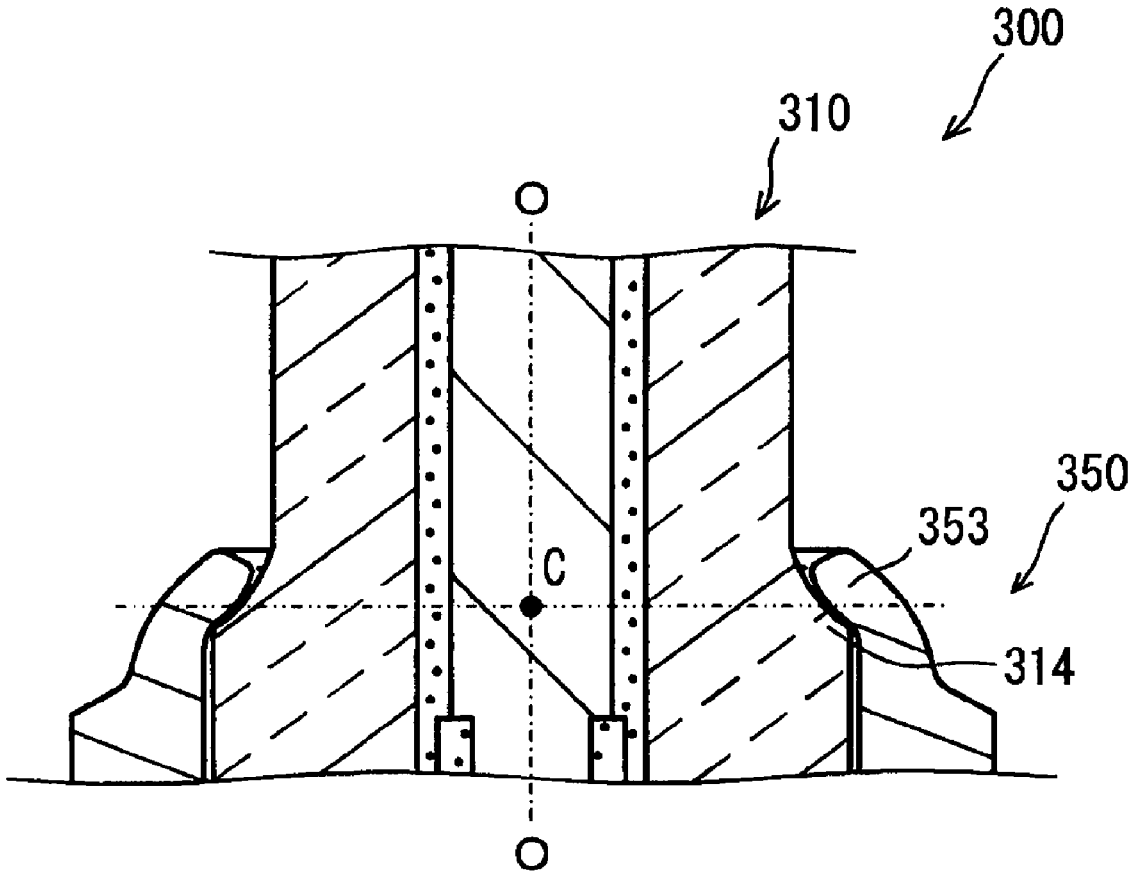
FIG. 4 is a partial sectional view of a spark plug 300 as a modified example.

Of course, as is shown in FIG. 4, this is also true with a spark plug 300 in which without packings 6, 7 and talc 9 (refer to FIG. 1), a crimping portion 353 of a metal shell 350 is brought into direct abutment with a shoulder portion 314 of an insulator 310 so as to support the insulator 310. Namely, an abutment position where the crimping portion 353, which is first brought into abutment with the insulator 310 from a rear end side in an axis O direction, is in abutment with the insulator 310 may be referred to as a position C.

Figure 5:
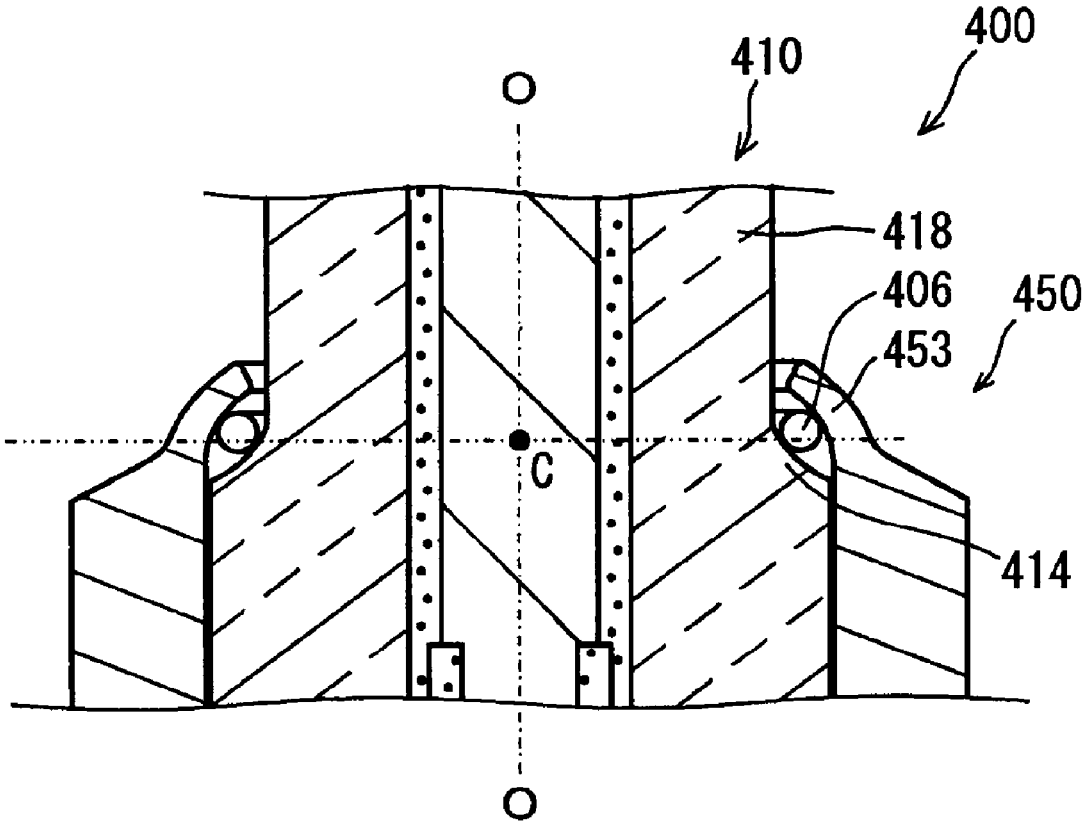
FIG. 5 is a partial sectional view of a spark plug 400 as a modified example.

As with a spark plug 400 shown in FIG. 5, a packing 406 which is interposed between a crimping portion 453 of a metal shell 450 and an insulator 410 is not brought into abutment with a rear end side body portion 418 but may be brought into abutment with a shoulder portion 414. A position C is the same as that of the embodiment, and since it is the packing 406 that is first brought into abutment with the insulator 410 from a rear end side in an axis O direction, the position where the packing 406 is in abutment with the insulator 410 may be referred to as the position C.

Evaluation tests were carried out to verify that in the event that the insulator 10 is designed by adjusting the balance of the size and modulus of section of each portion of the insulator 10, the insulator 10 having the sufficient strength (rigidity) can be obtained so as to prevent the generation of cracks or fractures therein.

Example 1

In the evaluation tests, several types of metal shells were prepared which had a nominal diameter of threads of a mounting tread portion of M10 and different lengths in the axis O direction, and insulators having dimensions that enable the insulators to be mounted in the metal shells were designed into 39 types and 14 classifications. Specifically, every insulator was designed so that the length LAC between the position A and the position C became 26 mm when a spark plug was measured after the insulator was mounted in the metal shell. The length LBC between the position B and the position C was made to differ within a range of 25 to 33 mm from insulator to insulator so as to match the types of the metal shells in which the insulators could be mounted. Further, the insulators were designed so that thicknesses of respective portions thereof were made different by, for example, inside diameters of axial holes being made different, so that the test samples have different combinations of moduli of section ZXmax, ZYmax. 10 insulators were prepared for each of the insulators of 30 types and 14 classifications in which design values (values of LAC, LBC, LXmax, LYmax, ZXmax and ZYmax) were made different from each other and were mounted in the corresponding metal shells, whereby test samples of spark plugs to be tested were built up. In addition, for comparison, 10 insulators were prepared for each of two types of current spark plug products in which the LAC between the position A and the position C was 26 mm and the nominal diameter of threads of a mounting thread portion is larger than M10. Sample numbers for use in identifying the individual test samples and the current spark plug products are such as those shown in Table 1, which will be described later.

One insulator was picked up from each of the test samples of 39 types and the current spark plug products of two types so as to be mounted on a test device for impact resistance testing. Then, impact was kept applied to those insulators for 120 minutes at a rate of 400 times per minute, and thereafter, whether or not abnormality such as cracks or fractures was generated in the insulators was investigated. In the event that the abnormality was generated in even one of 10 insulators of each type, the relevant type was judged that the adjustment of balance of the size and modulus of section thereof was so insufficient that a desirable proof strength could not be obtained against a local stress concentration and was evaluated as "bad". In the event that no abnormality was found in all the 10 insulators of each type, the relevant type was judged that a sufficient proof strength could be obtained as a result of the adjustment of balance and was evaluated as "good". The results of the evaluation tests are shown in Table 1. In addition to this, τA and τB obtained from the design values of the respective test samples based on the equation (1) and the equation (2), which are described above, and τA/τB are also described in Table 1, as well.

TABLE 1

| Test Sample | LAC [mm] | LBC [mm] | LAXmax [mm] | LBYmax [mm] | Zvmax [mm$^3$] | Zymax [mm$^3$] | τA | τB | τA/τB | Impact test 120 minutes |
|---|---|---|---|---|---|---|---|---|---|---|
| A-1 | 26 | 33 | 26 | 20.77 | 97.33 | 37.07 | 0.27 | 0.44 | 0.61 | Good |
| A-2 | 26 | 25 | 26 | 12.77 | 97.33 | 37.07 | 0.27 | 0.36 | 0.75 | Good |

TABLE 1-continued

| Test Sample | LAC [mm] | LBC [mm] | LAXmax [mm] | LBYmax [mm] | Zvmax [$mm^3$] | Zymax [$mm^3$] | τA | τB | τA/τB | Impact test 120 minutes |
|---|---|---|---|---|---|---|---|---|---|---|
| B-1 | 26 | 33 | 26 | 20.77 | 97.33 | 29.68 | 0.27 | 0.55 | 0.48 | Bad |
| B-2 | 26 | 27 | 26 | 14.77 | 97.33 | 29.68 | 0.27 | 0.48 | 0.56 | Bad |
| B-3 | 26 | 25 | 26 | 12.77 | 97.33 | 29.68 | 0.27 | 0.45 | 0.60 | Good |
| C-1 | 26 | 31 | 26 | 18.77 | 70.65 | 29.68 | 0.37 | 0.53 | 0.69 | Bad |
| C-2 | 26 | 29 | 26 | 16.77 | 70.65 | 29.68 | 0.37 | 0.51 | 0.73 | Good |
| C-3 | 26 | 25 | 26 | 12.77 | 70.65 | 29.68 | 0.37 | 0.45 | 0.82 | Good |
| D-1 | 26 | 33 | 26 | 20.77 | 70.65 | 22.68 | 0.37 | 0.72 | 0.51 | Bad |
| D-2 | 26 | 25 | 26 | 12.77 | 70.65 | 22.68 | 0.37 | 0.59 | 0.63 | Bad |
| E-1 | 26 | 33 | 26 | 20.77 | 59.33 | 22.68 | 0.44 | 0.72 | 0.61 | Bad |
| E-2 | 26 | 27 | 26 | 14.77 | 59.33 | 22.68 | 0.44 | 0.63 | 0.70 | Bad |
| E-3 | 26 | 25 | 26 | 12.77 | 59.33 | 22.68 | 0.44 | 0.59 | 0.75 | Good |
| F-1 | 26 | 25 | 26 | 12.77 | 55.15 | 37.08 | 0.47 | 0.36 | 1.32 | Bad |
| F-2 | 26 | 31 | 26 | 18.77 | 55.15 | 22.68 | 0.47 | 0.69 | 0.68 | Bad |
| F-3 | 26 | 29 | 26 | 16.77 | 55.15 | 22.68 | 0.47 | 0.66 | 0.71 | Good |
| F-4 | 26 | 25 | 26 | 12.77 | 55.15 | 22.68 | 0.47 | 0.59 | 0.81 | Good |
| G-1 | 26 | 33 | 26 | 20.77 | 40.34 | 22.68 | 0.64 | 0.72 | 0.89 | Good |
| G-2 | 26 | 25 | 26 | 12.77 | 40.34 | 22.68 | 0.64 | 0.59 | 1.10 | Good |
| H-1 | 26 | 33 | 26 | 20.77 | 29.68 | 22.68 | 0.88 | 0.72 | 1.21 | Good |
| H-2 | 26 | 31 | 26 | 18.77 | 29.68 | 22.68 | 0.88 | 0.69 | 1.26 | Good |
| H-3 | 26 | 29 | 26 | 16.77 | 29.68 | 22.68 | 0.88 | 0.66 | 1.32 | Bad |
| H-4 | 26 | 25 | 26 | 12.77 | 29.68 | 22.68 | 0.88 | 0.59 | 1.50 | Bad |
| I-1 | 26 | 33 | 26 | 20.77 | 19.87 | 22.68 | 1.31 | 0.72 | 1.81 | Bad |
| I-2 | 26 | 25 | 26 | 12.77 | 19.87 | 22.68 | 1.31 | 0.59 | 2.23 | Bad |
| J-1 | 26 | 33 | 26 | 20.77 | 40.34 | 12.27 | 0.64 | 1.33 | 0.48 | Bad |
| J-2 | 26 | 25 | 26 | 12.77 | 40.34 | 12.27 | 0.64 | 1.08 | 0.60 | Bad |
| K-1 | 26 | 33 | 26 | 20.77 | 40.34 | 15.81 | 0.64 | 1.03 | 0.62 | Bad |
| K-2 | 26 | 29 | 26 | 16.77 | 40.34 | 15.81 | 0.64 | 0.95 | 0.68 | Bad |
| K-3 | 26 | 27 | 26 | 14.77 | 40.34 | 15.81 | 0.64 | 0.90 | 0.72 | Good |
| K-4 | 26 | 25 | 26 | 12.77 | 40.34 | 15.81 | 0.64 | 0.84 | 0.77 | Good |
| L-1 | 26 | 33 | 26 | 20.77 | 40.34 | 29.68 | 0.64 | 0.55 | 1.17 | Good |
| L-2 | 26 | 29 | 26 | 16.77 | 40.34 | 29.68 | 0.64 | 0.51 | 1.27 | Good |
| L-3 | 26 | 27 | 26 | 14.77 | 40.34 | 29.68 | 0.64 | 0.48 | 1.35 | Bad |
| L-4 | 26 | 25 | 26 | 12.77 | 40.34 | 29.68 | 0.64 | 0.45 | 1.44 | Bad |
| M-1 | 26 | 33 | 26 | 20.77 | 40.34 | 37.08 | 0.64 | 0.44 | 1.46 | Bad |
| M-2 | 26 | 25 | 26 | 12.77 | 40.34 | 37.08 | 0.64 | 0.36 | 1.80 | Bad |
| N-1 | 26 | 33 | 26 | 20.77 | 40.34 | 49.25 | 0.64 | 0.33 | 1.94 | Bad |
| N-2 | 26 | 25 | 26 | 12.77 | 40.34 | 49.25 | 0.64 | 0.27 | 2.39 | Bad |
| Current Product 1 | 26 | 25.5 | 26 | 13.16 | 111.43 | 73.94 | 0.23 | 0.18 | 1.29 | Good |
| Current Product 2 | 26 | 25 | 26 | 12.16 | 111.43 | 35.06 | 0.23 | 0.36 | 0.65 | Good |

As is shown in Table 1, in the current product 1 and the current product 2, since τA and τB are both smaller than 0.47 and a sufficient proof strength was obtained at any portion of the insulator, no cracks or fractures were generated therein. In the test samples A-1, A-2, B-3, C3 in which τA and τB are both smaller than 0.47, as with the current products, a sufficient proof strength against bending was obtained at any portion of the insulator, and irrespective of the value of τA/τB, good results were obtained in the impact tests. On the other hand, in any of the other test samples, a value of either of τA and τB or values of both τA and τB are 0.47 or larger, there is a fear that depending upon the portion of the insulator, a sufficient proof strength against bending is not obtained. However, among those test samples, in the test samples C-2, E-3, F-3, F-4, G-1, G-2, H-1, H-2, K-3, K-4, L-1 and L-2 in which τA/τB was made to fall within a range of 0.71 to 1.27 by adjusting the balance of size and modulus of section of the insulator, good results were obtained in the impact tests. It was found from the results of the evaluation tests that even in the event that at least either of τA and τB took a value of 0.47 or larger, causing a fear that depending on the portion of the insulator, a sufficient proof strength against bending could not be obtained, a stress produced by an external impact could be dispersed to be mitigated by adjusting the balance, as a result of which the generation of cracks or fractures in the insulator could be prevented.

While the invention has been described in detail and by reference to the specific embodiment, it is obvious to those skilled in the art to which the invention pertains that various alterations and modifications can be made thereto without departing from the spirit and scope of the invention.

This patent application is based on Japanese Patent Application (No. 2008-69865) filed on May 18, 2008, the entire contents of which are incorporated herein by reference.

The invention claimed is:

1. A spark plug comprising:

an insulator holding a center electrode in an interior of an axial hole thereof which is formed in an axial direction, the insulator comprising:

a front end side body portion having a stepped portion on a front end side of an outer circumferential surface thereof;

an intermediate body portion formed on a rear end side of the front end side body portion and having a larger diameter than that of the front end side body portion; and a rear end side body portion formed on a rear end side of the intermediate body portion with interposing a shoulder portion and having a smaller diameter than that of the intermediate body portion;

a metal shell comprising:

a tool engagement portion for mounting the spark plug on an internal combustion engine;

a crimping portion formed on a rear end side with respect to the tool engagement portion; and a ledge portion formed on a front end side with respect to the tool engagement portion within an inner hole of the metal shell and projecting radially inwards, wherein the metal shell holds a portion of the insulator which lies from the shoulder portion to the stepped portion of the insulator between the clamping portion and the ledge portion; and an annular packing interposed between the ledge portion and the stepped portion, wherein in $$\tau A = LAX\max / ZX\max, \text{ and}$$

$$\tau B = (LAC \cdot LBY\max)/(LBC \cdot ZY\max),$$

at least either τA or τB is 0.47 or larger, and $0.71 \leqq \tau A/\tau B \leqq 1.27$ is satisfied, where, in the axial direction, A represents a position where a rear end of the insulator is situated;

B represents a position where the insulator and the packing are first brought into contact with each other from a front end side of the insulator;

C represents a position where the insulator and the clamping portion are first brought into contact with each other from a rear end side of the insulator;

LAC represents a length between the position A and the position C;

LBC represents a length between the position B and the position C;

X represents an arbitrary position between the position A and the position C;

Y represents an arbitrary position between the position B and the position C;

LAX represents a length between the position A and the position X;

LBY represents a length between the position B and the position Y;

ZX represents a modulus of section of the insulator at the position X;

ZY represents a modulus of section of the insulator at the position Y;

Xmax represents a position of the position X where LAX/ZX takes a maximum value;

Ymax represents a position of the position Y where LBY/ZY takes a maximum value;

LAXmax represents a length between the position A and the position X max;

LBYmax represents a length between the position B and the position Ymax;

ZXmax represents a modulus of section of the insulator at a portion of the position Xmax; and ZYmax represents a modulus of section of the insulator at a portion of the position Ymax.

2. The spark plug according to claim 1, wherein the metal shell includes a mounting thread portion on the front end side with respect to the tool engagement portion in which threads are formed for mounting the spark plug on the internal combustion engine, and a nominal diameter of threads of the mounting thread portion is M10 or smaller.

3. The spark plug according to claim 1, wherein an outside diameter of the rear end side body portion of the insulator is ϕ8.5 mm or smaller.

4. A spark plug comprising:

an insulator holding a center electrode in an interior of an axial hole thereof which is formed in an axial direction, the insulator comprising:

a front end side body portion having a stepped portion on a front end side of an outer circumferential surface thereof;

an intermediate body portion formed on a rear end side of the front end side body portion and having a larger diameter than that of the front end side body portion; and a rear end side body portion formed on a rear end side of the intermediate body portion with interposing a shoulder portion and having a smaller diameter than that of the intermediate body portion;

a metal shell comprising:

a tool engagement portion for mounting the spark plug on an internal combustion engine;

a crimping portion formed on a rear end side with respect to the tool engagement portion; and a ledge portion formed on a front end side with respect to the tool engagement portion within an inner hole of the metal shell and projecting radially inwards, wherein the metal shell holds a portion of the insulator which lies from the shoulder portion to the stepped portion of the insulator between the clamping portion and the ledge portion;

an annular first packing interposed between the ledge portion and the stepped portion; and an annular second packing interposed between the clamping portion of the metal shell and the shoulder portion or the rear end side body portion of the insulator, wherein in $$\tau A = LAX\max / ZX\max, \text{ and}$$

$$\tau B = (LAC \cdot LBY\max)/(LBC \cdot ZY\max),$$

at least either τA or τB is 0.47 or larger, and $0.71 \leqq \tau A/\tau B \leqq 1.27$ is satisfied wherein, in the axial direction, A represents a position where a rear end of the insulator is situated;

B represents a position where the insulator and the first packing are first brought into contact with each other from a front end side of the insulator;

C represents a position where the insulator and the second packing are first brought into contact with each other from a rear end side of the insulator;

LAC represents a length between the position A and the position C;

LBC represents a length between the position B and the position C;

X represents an arbitrary position between the position A and the position C;

Y represents an arbitrary position between the position B and the position C;

LAX represents a length between the position A and the position X;

LBY represents a length between the position B and the position Y;

ZX represents a modulus of section of the insulator at the position X;

ZY represents a modulus of section of the insulator at the position Y;

Xmax represents a position of the position X where LAX/ZX takes a maximum value;

Ymax represents a position of the position Y where LBY/ZY takes a maximum value;

LAXmax represents a length between the position A and the position Xmax;

LBYmax represents a length between the position B and the position Ymax;

ZXmax represents a modulus of section of the insulator at a portion of the position Xmax; and ZYmax represents a modulus of section of the insulator at a portion of the position Ymax.

5. The spark plug according to claim 4, wherein the metal shell includes a mounting thread portion on the front end side with respect to the tool engagement portion in which threads are formed for mounting the spark plug on the internal combustion engine, and a nominal diameter of threads of the mounting thread portion is M10 or smaller.

6. The spark plug according to claim 4, wherein an outside diameter of the rear end side body portion of the insulator is ϕ8.5 mm or smaller.

* * * * *